US011110034B2

(12) United States Patent
Dang et al.

(10) Patent No.: US 11,110,034 B2
(45) Date of Patent: Sep. 7, 2021

(54) MEDICINE PILL CUTTER

(71) Applicant: 3 Cut Pro LLC, St. Augustine, FL (US)

(72) Inventors: Dat T Dang, Orlando, FL (US); Roy H. Hinman, II, Palm Coast, FL (US)

(73) Assignee: 3 CUT PRO LLC, St. Augustine, FL (US)

( * ) Notice: Subject to any disclaimer, the term of this patent is extended or adjusted under 35 U.S.C. 154(b) by 0 days.

(21) Appl. No.: 16/785,803

(22) Filed: Feb. 10, 2020

(65) Prior Publication Data

US 2020/0297583 A1 Sep. 24, 2020

Related U.S. Application Data

(60) Provisional application No. 62/820,694, filed on Mar. 19, 2019.

(51) Int. Cl.
*A61J 7/00* (2006.01)

(52) U.S. Cl.
CPC ..... *A61J 7/0007* (2013.01)

(58) Field of Classification Search
None
See application file for complete search history.

(56) References Cited

U.S. PATENT DOCUMENTS

| | | | | |
|---|---|---|---|---|
| 6,601,746 | B2 * | 8/2003 | Buckley | A61J 7/0007 206/528 |
| 7,828,181 | B1 * | 11/2010 | Reitano | B26D 3/30 225/1 |
| 8,430,287 | B2 * | 4/2013 | Sze | B26D 7/22 225/1 |
| 10,398,628 | B2 * | 9/2019 | Raghuprasad | B26D 7/01 |
| 10,420,706 | B2 * | 9/2019 | Lee | A61J 7/0007 |
| 10,524,986 | B2 * | 1/2020 | Meritt | B65D 83/0445 |
| 2003/0019900 | A1 * | 1/2003 | Dienst | A61J 7/0007 225/104 |
| 2016/0051448 | A1 * | 2/2016 | Ferraro | A61J 7/0007 83/468.7 |
| 2019/0105232 | A1 * | 4/2019 | Fallah | B26D 3/30 |
| 2020/0297583 | A1 * | 9/2020 | Dang | A61J 7/0007 |

* cited by examiner

*Primary Examiner* — Hwei-Siu C Payer
(74) *Attorney, Agent, or Firm* — WPAT, PC

(57) ABSTRACT

The current invention directs to a medicine pill cutter. The medicine pill cutter comprises a top portion, a bottom portion and a triangular insert. The top portion has a central rib and two side ribs, wherein a triangular slot is formed between the two side ribs. The bottom portion is linked with the top portion via a pivot. The bottom portion has two blades and a spring positioned between the two blades, wherein the spring has a notch and the two blades are arranged in a V-shape. The triangular insert has a knot connected to the notch of the spring. A pill can be evenly divided into more than two sections via the use of the medicine pill cutter of the present invention.

11 Claims, 4 Drawing Sheets

MEDICINE PILL CUTTER

PRIORITY

This application claims a domestic priority of the provisional application No. 62/820,694 filed on Mar. 19, 2019.

FIELD OF THE INVENTION

The present invention relates to a medicine pill cutter, particularly to a medicine pill cutter 10 that can evenly divide the pill into more than two sections.

BACKGROUND OF THE INVENTION

As well known to those skilled in the art, it is sometime necessary to split medication pill into several smaller portions for either adjusting dosage or easier for the patient to swallow. The conventional medicine pill cutters are only capable of cutting a medicine pill into two halves. However, there are many types of medicines, and some medicines need to be cut into more sections in order to meet the dosage requirements. Thus, there is a need for evenly dividing the pill into more than two sections.

SUMMARY OF THE INVENTION

An objective of the present invention is to solve the above-mentioned problems and to provide a medicine pill cutter. The present invention achieves the above-indicated objective by providing a medicine pill cutter.

The medicine pill cutter comprises a top portion, a bottom portion and a removable triangular insert. The top portion has a central rib and two side ribs, wherein a triangular slot is formed between the two side ribs. Each of the two side ribs has notches or indentations for securing pills.

The bottom portion is linked with the top portion via a pivot. The bottom portion has two blades, where the two blades are arranged in a V-shape. The removable triangular insert, with a spring underneath, positioned between the two blades. The triangular insert has a knot connected to the notch of the spring.

Compared to traditional medicine pill cutters, the present invention has several advantages. First, the prefer embodiment enables a pill to be cut into three sections in order to meet the dosage requirements. Second, the medicine pill cutter of the present invention is a closed box. Safely, the medicine pill cutter and pill sections processed will not be polluted. Finally, a pill can be evenly divided into more than two sections via the use of the medicine pill cutter of the present invention.

DETAILED DESCRIPTION OF THE PREFERRED EMBODIMENT

Figure 1:
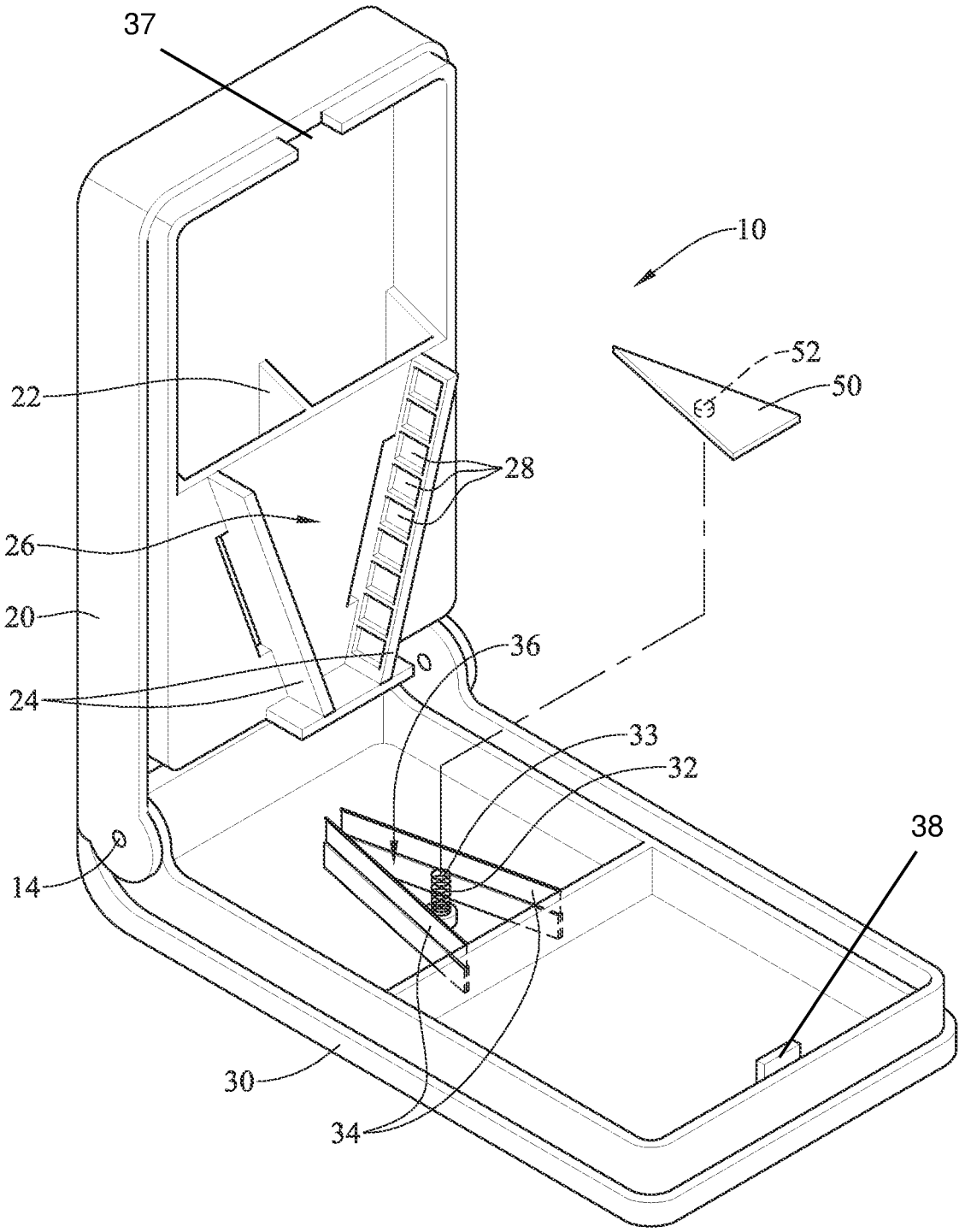
FIG. 1 shows a medicine pill cutter 10 in the opening position with a triangular insert 50 next to the medicine pill cutter 10.

FIGS. 1-4 show aspects of a medicine pill cutter 10 of the present invention. FIG. 1 is a perspective view of a medicine pill cutter 10 in the opening position with a triangular insert 50 next to the medicine pill cutter 10.

As shown in the FIG. 1, a medicine pill cutter 10 has a top portion 20 and a bottom portion 30, where the top portion 20 and the bottom portion 30 are connected via the hinge 14 or a pivot.

The top portion 20 has a hallow platform supported by the central rib 22. The hallow platform only occupy the lower half of the top portion 20 near the hinge 14. The edge of the hallow platform continues extending along the perimeter of the top portion 20, and form a notch 37. The two side ribs 24 are positioned on the hallow platform. And, a triangular slot 26 is formed between the two side ribs 24. Each of the two side ribs 24 has preset indentations 28.

The bottom portion 30 has an inner recess and an outer recess, the inner recess is near the hinge 14 while the outer recess is away from the hinge 14. The two blades 34 are positioned in the inner recess near the hinge 14, and the spring 32 is positioned between two blades 34. The two blades 34 are arranged in a V-shape 36. The V-shape 36 is corresponding to the triangular slot 26, and the V-shape 36 is narrower than the triangular slot 26. The outer recess has tap 38 corresponding to the notch 37 of the hallow platform from the top portion 20. The bottom portion 30 is linked with the top portion 20 20 via a hinge 14.

A removable triangular insert 50 has a knot 52 with the spring 32 attached underneath.

Figure 2:
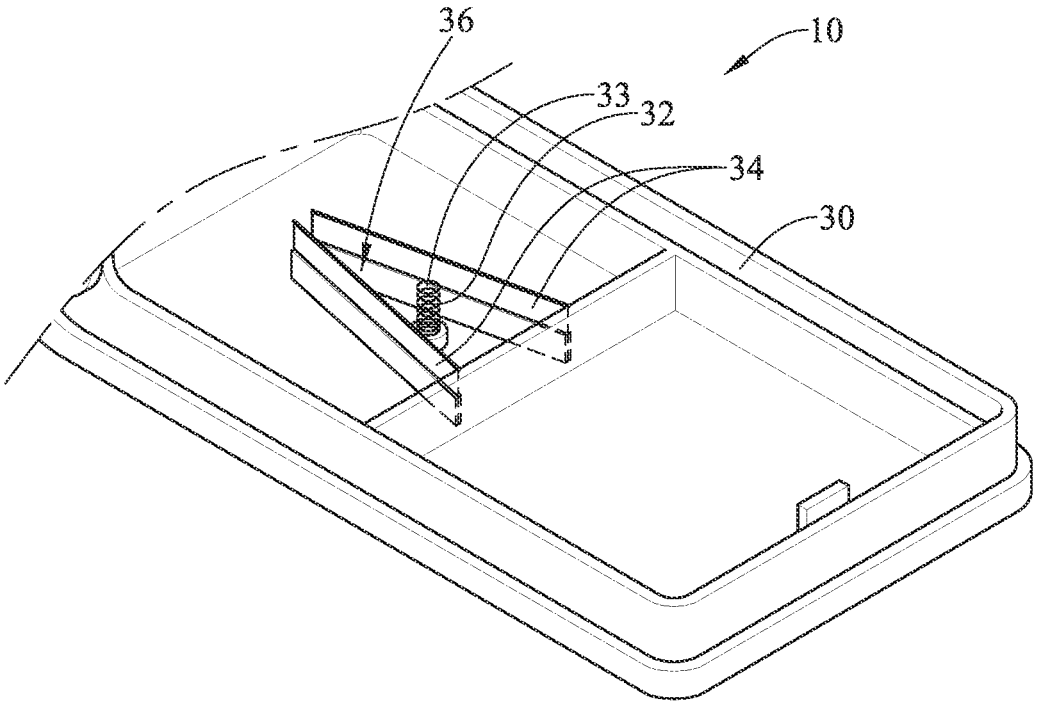
FIG. 2 shows a spring located between two blades 34 and the two blades 34 form a V-shape.

FIG. 2 is a perspective view of the spring located between the two blades 34 and the two blades 34 form the V-shape. As shown in the FIG. 2, the spring 32 with a notch 37 33 located between the two blades 34 and the two blades 34 form the V-shape 36.

Figure 3:
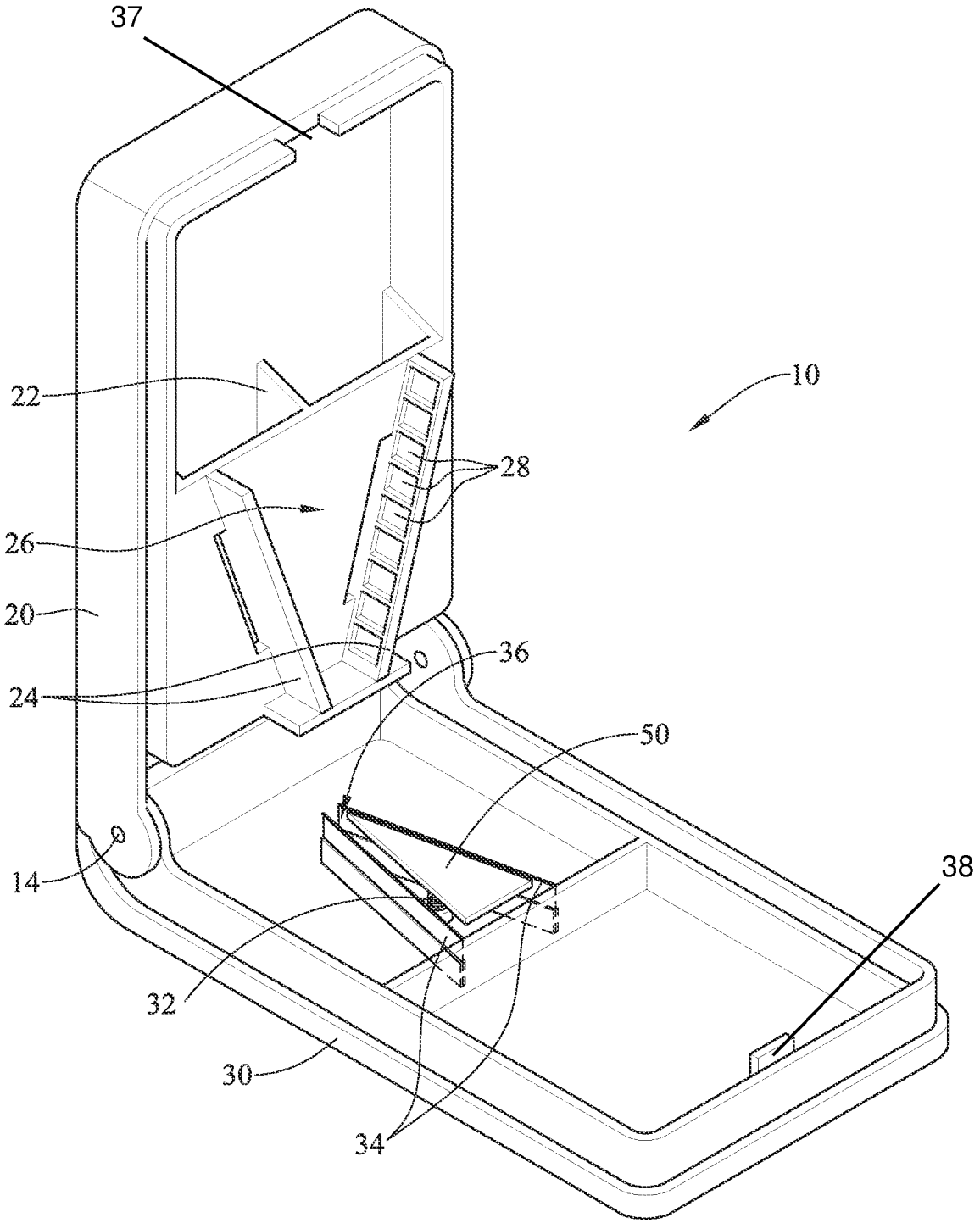
FIG. 3 shows the triangular insert 50 is positioned between the two blades 34 and on the top of the spring.

FIG. 3 is a perspective view of the medicine pill cutter 10 with the triangular insert 50 positioned between the two blades 34. As shown in the FIG. 3, the triangular insert 50 is positioned between the two blades 34 and on the top of the spring 32, with the knot 52 securely connected to the notch 37 33 of the spring 32.

Figure 4:
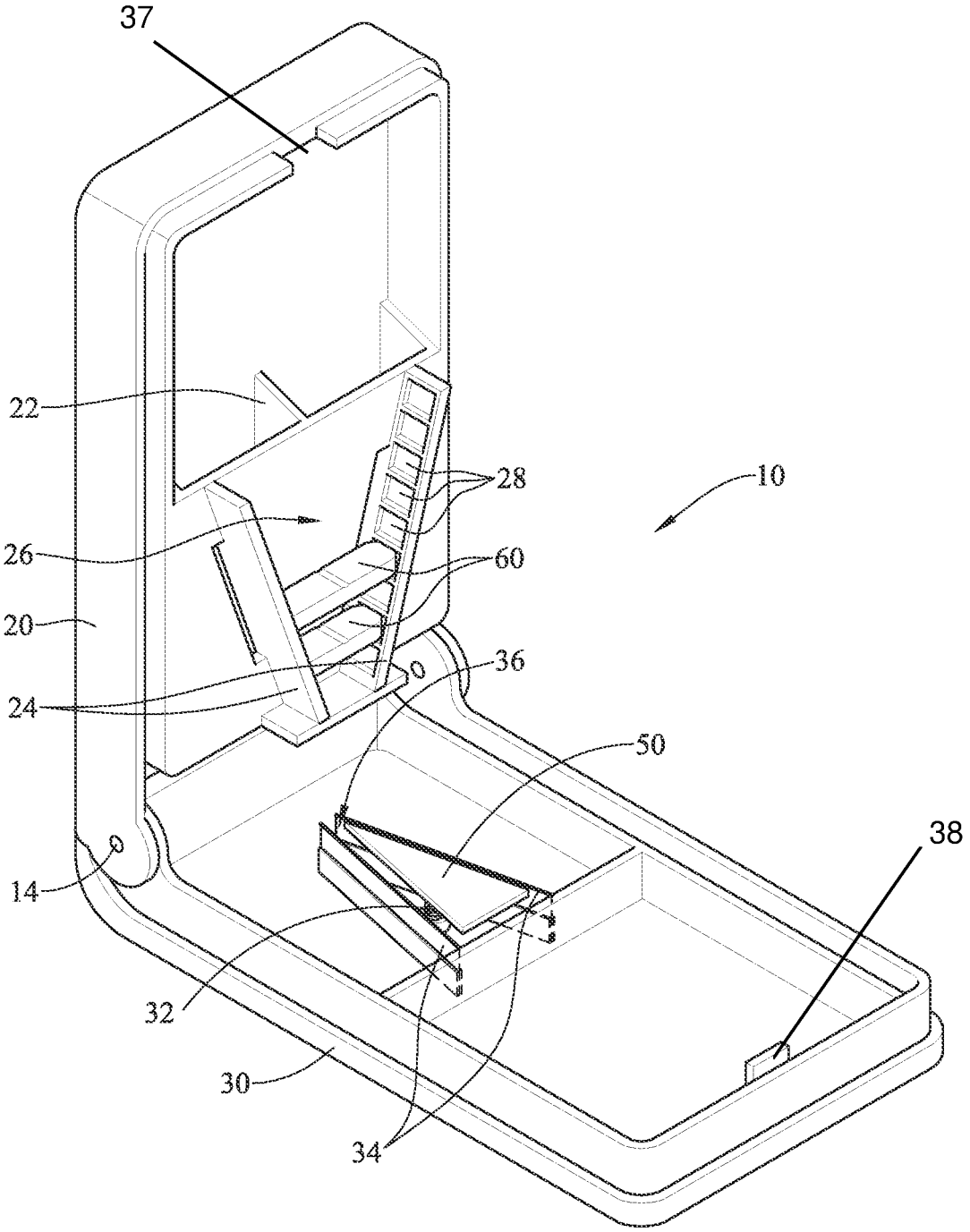
FIG. 4 shows the medicine pill cutter 10 is capable to cut a pill into three sections.

The medicine pill cutter 10 is capable to cut one or more pills 60 into three sections as shown in the FIG. 4. The triangular insert 50 with the spring 32 can assist a center divided pill section to be ejected away from the two blades 34. The top portion 20 has the triangular slot 26 corresponding to the two blades 34 at the bottom portion 30 of the medicine pill cutter 10. The preset indentations 28 of the two side ribs 24 are used for positioning the pill 60 within the triangular slot 26 securely and evenly. The central rib 22 is used to force the pill 60 to be cut with the two blades 34. As the side ribs 24 and blades 34 are positioned near the hinge 14, such arrangement minimizes user's effort in cutting the medicine pills 60 when user pushes the top portion 20 and the bottom portion 20 together.

Arranging side ribs 24 and blades 34 in triangular formation is preferred since the triangular shape can easily accommodate different sizes of pills. User can position the pill 60 anywhere between the two side ribs 24 depending on the size of the pill 60, and secure the pill 60 by pressing the pill 60 firmly against or into the corresponding indentations 28 of the side ribs 24. Once the pill 60 is secured between the two side ribs 24, firmly close the top portion 20 and the bottom portion 30 to cut the pill 60. As the blades 34 cut the pills 60 into different portions, the portion between blades 34 usually will stuck between blades 34. The moveable insert 50 and the spring 32 underneath will push the portion between the two adjacent blades 34 out of the slot 26. The spring 32 can also be replaced with other expandable elastic structure.

The central rib 22 also divides the hallow platform into two pockets. The instant invention can also function as a medicine storage box which user can store the medicine pills (whole or portion) into the pockets.

A different embodiment can be implemented by inserting additional blades for cutting pills into more even sections, or additional springs. A different embodiment can also arrange the blades into a different formation.

A different embodiment can have more than three blades arranged in a triangular formation, and the each triangular slot between any two adjacent blades will equip with a removable triangular insert with a spring underneath.

Another different embodiment can have multiple blades arranged in parallel, and each slot between any given two adjacent blades will have a moveable insert with a spring attached underneath.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A medicine pill cutter, comprising:

a top portion, having two side ribs for positioning pills, wherein the two side ribs are arranged to form a triangular slot;

a bottom portion, having two blades and a spring positioned between the two blades, wherein the two blades are arranged in a V-shape corresponding to the triangular slot, and the bottom portion is linked with the top portion via a connector; and a triangular insert, having a knot connected to the spring to be movable with the spring for ejecting a portion of a cut pill stuck between the blades.

2. The medicine pill cutter as recited in claim 1, wherein each of the two side ribs has preset indentations for positioning a pill within the triangular slot securely and evenly.

3. The medicine pill cutter as recited in claim 1, wherein the top portion further comprises a central rib to force a pill to be cut by the two blades.

4. The medicine pill cutter as recited in claim 1, wherein the bottom portion further comprises an inner recess and an outer recess, the inner recess is near the connector, and the two blades are positioned within the inner recess.

5. The medicine pill cutter as recited in claim 4, wherein the top portion has a notch and the outer recess has a tab corresponding to the notch for closing the medicine pill cutter.

6. The medicine pill cutter as recited in claim 1, wherein the top portion further comprises a hallow platform, and the two side ribs are positioned on the hallow platform near the connector.

7. The medicine pills cutter as recited in claim 6, wherein top portion further comprises a central rib underneath the hallow platform, the central rib divides the hallow platform into two pockets for storing the medicine pill.

8. The medicine pill cutter as recited in claim 1, wherein the connector is a hinge or a pivot.

9. A medicine pill cutter, comprising:

a top portion, having two side ribs, wherein the two side ribs have preset indentations for positioning pills;

a bottom portion linked with the top portion via a pivot;

a first blade and a second blade position on said bottom portion;

a spring positioned on said bottom portion and between said first blade and said second blade; and a removable insert positioned above said spring and attached to said spring to be movable with said spring for ejecting a portion of a cut pill stuck between the blades.

10. The medicine pill cutter as recited in claim 9, wherein the top portion further comprises a central rib to force a pill to be cut by the blades.

11. A method for cutting a medicine pill, comprising:

providing and positioning a first rib with indentations and a second rib with indentations to form a triangular slot on a top cover;

providing and positioning a first blade and a second blade arranged as a V-shape on a bottom cover, wherein the V-shape is corresponding to the triangular slot, and the bottom cover and the top cover are attached via a hinge;

providing a triangular insert and a spring, wherein the triangular insert attached to the bottom cover via the spring, and the triangular insert is positioned between the first blade and the second blade;

securing the medicine pill between the first rib and the second rib;

cutting the medicine pill with the blades by closing the top cover and the bottom cover together; and pivoting the top cover away from the bottom cover so that the portion of the cut medicine pill stuck between the blades is ejected by the triangular insert and the spring.

* * * * *